US011846108B2

(12) United States Patent
Pearce

(10) Patent No.: US 11,846,108 B2
(45) Date of Patent: Dec. 19, 2023

(54) CONVERTIBLE SHIPPING CONTAINER

(71) Applicant: Beverly Pearce, Winchester, VA (US)

(72) Inventor: Beverly Pearce, Winchester, VA (US)

( * ) Notice: Subject to any disclaimer, the term of this patent is extended or adjusted under 35 U.S.C. 154(b) by 317 days.

(21) Appl. No.: 17/173,192

(22) Filed: Feb. 10, 2021

(65) Prior Publication Data

US 2021/0246675 A1 Aug. 12, 2021

Related U.S. Application Data

(60) Provisional application No. 62/972,140, filed on Feb. 10, 2020.

(51) Int. Cl.

| | |
|---|---|
| ***E04B 1/344*** | (2006.01) |
| ***B65D 88/12*** | (2006.01) |
| ***E04H 1/12*** | (2006.01) |

(52) U.S. Cl.

CPC ..... *E04H 1/1205* (2013.01); *B65D 88/121* (2013.01); *E04B 1/3444* (2013.01); *E04B 1/3448* (2013.01); *E04H 2001/1283* (2013.01)

(58) Field of Classification Search

CPC ..... E04B 1/3444; E04B 1/344; E04B 1/3442; E04B 1/3448; E04H 2001/1283; E04H 1/1205; B65D 88/121

See application file for complete search history.

(56) References Cited

U.S. PATENT DOCUMENTS 1,899,241 A 2/1933 Marr
2,765,499 A * 10/1956 Couse ..... E04B 1/3442 52/79.5
3,236,014 A * 2/1966 Edgar ..... E04B 1/34315 D25/1

(Continued)

FOREIGN PATENT DOCUMENTS

| | | |
|---|---|---|
| AU | 2013220923 | 8/2013 |
| AU | 2013101241 | 12/2013 |

(Continued)

OTHER PUBLICATIONS

English machine translation of EP 0087990 obtained from the European Patent Office at https://worldwide.espacenet.com/ (last accessed on Mar. 14, 2023) (Year: 1983).*

*Primary Examiner* — Brian D Mattei
*Assistant Examiner* — Charissa Ahmad
(74) *Attorney, Agent, or Firm* — Jacob M. Ward; Ward Law Office LLC

(57) ABSTRACT

A convertible container includes a top panel, a first longitudinal wall panel, a second longitudinal wall panel, and a bottom panel. The first longitudinal wall panel has a first longitudinal edge. The first longitudinal edge is connected to the top panel via a hinge. The second longitudinal wall panel has a second longitudinal edge. The second longitudinal edge is connected to the top panel at a fixed 90-degree angle. The bottom panel has an openable edge. The bottom panel is permanently coupled to the first longitudinal wall panel and removably coupled to the second longitudinal wall panel at the openable edge. The top panel is moveable between a first configuration and a second configuration. A method of assembling a functional structure includes providing the convertible container and lifting and rotating the second longitudinal wall panel away from the bottom panel about the hinge.

20 Claims, 6 Drawing Sheets

(56) References Cited

U.S. PATENT DOCUMENTS 3,653,165 A 4/1972 West
3,984,948 A * 10/1976 Bussard ..... E04B 1/3442 52/79.5
4,074,475 A * 2/1978 Wahlquist ..... E04B 1/3445 52/143
4,327,529 A * 5/1982 Bigelow, Jr. ..... E04B 1/34315 52/92.1
4,545,171 A 10/1985 Colvin
4,633,626 A * 1/1987 Freeman ..... E04H 9/00 52/79.5
4,891,919 A * 1/1990 Palibroda ..... E04B 1/3442 52/79.5
4,912,891 A * 4/1990 Bertrand ..... E04B 1/3444 52/66
5,265,394 A * 11/1993 Gardner ..... E04B 1/3442 52/640
5,511,908 A * 4/1996 Van Valkenburgh ..... B65F 1/1426 296/181.6
5,950,373 A 9/1999 Hoff et al.
6,179,522 B1 * 1/2001 Sanford ..... E04H 5/02 588/259
6,604,328 B1 * 8/2003 Paddock ..... E04H 1/1205 52/270
6,983,567 B2 * 1/2006 Ciotti ..... E04B 1/3442 52/79.5
7,827,738 B2 * 11/2010 Abrams ..... E04H 1/04 52/79.1
7,841,136 B2 * 11/2010 Czyznikiewicz ..... E04B 1/3444 52/64
8,322,086 B2 12/2012 Weber
8,347,560 B2 * 1/2013 Gyory ..... E04B 1/3483 52/79.5
8,578,661 B1 * 11/2013 Braley ..... A01M 31/02 52/79.5
8,590,214 B2 * 11/2013 Laprise ..... E04B 1/3442 52/69
8,720,126 B2 5/2014 Strickland et al.
9,333,820 B2 * 5/2016 Anabtawi ..... B60P 3/34
9,611,637 B2 * 4/2017 Dynon ..... E04B 1/34336
9,702,151 B2 7/2017 Cohen et al.
10,415,263 B2 9/2019 Lucho Do Valle
10,611,556 B2 4/2020 Yoo
2006/0101729 A1 5/2006 Waters
2009/0014044 A1 * 1/2009 Hartman ..... E04B 1/34336 135/143
2009/0044460 A1 * 2/2009 Medley ..... E04B 1/3444 52/741.1
2014/0150352 A1 * 6/2014 Lee ..... E04B 1/3444 52/79.5
2016/0153183 A1 * 6/2016 Richter ..... E04B 1/3442 52/79.5
2019/0078318 A1 3/2019 Strong
2020/0332512 A1 * 10/2020 Smith ..... E04B 1/3445

FOREIGN PATENT DOCUMENTS

CN 101636544 A * 1/2010 ..... E04B 1/344
CN 102191816 9/2011
CN 208734136 4/2019
DE 3412245 A1 * 12/1984
DE 3743102 A1 * 6/1989
DE 3932736 A1 * 4/1991 ..... E04B 1/3444
EP 0087990 A1 * 9/1983
EP 0132898 A1 * 2/1985 ..... B60P 3/025
EP 0280265 A1 * 8/1988 ..... B60P 3/34
FR 2268127 A1 * 11/1975
FR 2521195 A1 * 8/1983 ..... E04B 1/344
GB 2013751 A * 8/1979 ..... E04B 1/3442
GB 2290567 A * 1/1996 ..... E04B 1/3442
JP 2005097952 A * 4/2005
KR 100714159 5/2007
PL 178009 B1 * 2/2000
WO WO-8604630 A1 * 8/1986
WO WO-2007033498 A1 * 3/2007 ..... B60P 3/34
WO WO-2007094692 A1 * 8/2007 ..... E04B 1/3444
WO 2010057313 5/2010
WO WO-2011160167 A1 * 12/2011 ..... B60P 3/025
WO 2015155695 10/2015

* cited by examiner

CONVERTIBLE SHIPPING CONTAINER

CROSS-REFERENCE TO RELATED APPLICATION

This application claims benefit of U.S. Provisional Patent Application No. 62/972,140, filed on Feb. 10, 2020, which is hereby incorporated by reference for all purposes as if fully set forth herein.

BACKGROUND

Field

Exemplary embodiments relate to an intermodal shipping container that hinges open into a gable-roofed structure.

Discussion of the Background

The concept of manufacturing homes in a factory setting may offer more reliable environmental conditions and less waste. However, prefabricated home designs may suffer from drawbacks such as limited geographical range, the impact of transportation stresses on stick-built structures, and considerable site work to reconnect the modules and install their correlated components.

Shipping containers may be easily transportable, but the width and height of the containers may be restrictive for use as a residence. Various shipping container conversions can be expanded quickly and efficiently, but may require complicated couplings and other fittings, as well as require extensive post-production build-outs and finishes. Having multiple pivoting components and seams also makes such structures vulnerable to water infiltration and failure.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a convertible shipping container having a longitudinal edge having adjacent, rigidly-connected sides, longitudinal edge configured to hinge open to form a gable roof, the geometry of which increases the usable space underneath, which is then enclosed with wall panels to form a habitable structure.

Additional aspects will be set forth in the detailed description which follows, and, in part, will be apparent from the disclosure, or may be learned by practice of the inventive concept.

According to exemplary embodiments, a convertible shipping container includes a first longitudinal edge and a second longitudinal edge that is diagonally opposed to the first longitudinal edge in a first configuration and a hinged longitudinal edge and a lockable longitudinal edge that is diagonally opposed to the hinged longitudinal edge in the first configuration. The first longitudinal edge and the second longitudinal edge each comprise 90° fixed edges, and the lockable longitudinal edge is configured to be unlocked and opened to thereby expand the convertible shipping container into a second configuration.

According to exemplary embodiments, a method of forming a convertible shipping container dwelling unit, the method including forming a convertible shipping container including a first longitudinal edge, a second longitudinal edge that is diagonally opposed to the first longitudinal edge, a hinged longitudinal edge, and a lockable longitudinal edge that is diagonally opposed to the hinged longitudinal edge, unlocking the lockable longitudinal edge, and opening the lockable longitudinal edge to thereby expand the convertible shipping container.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
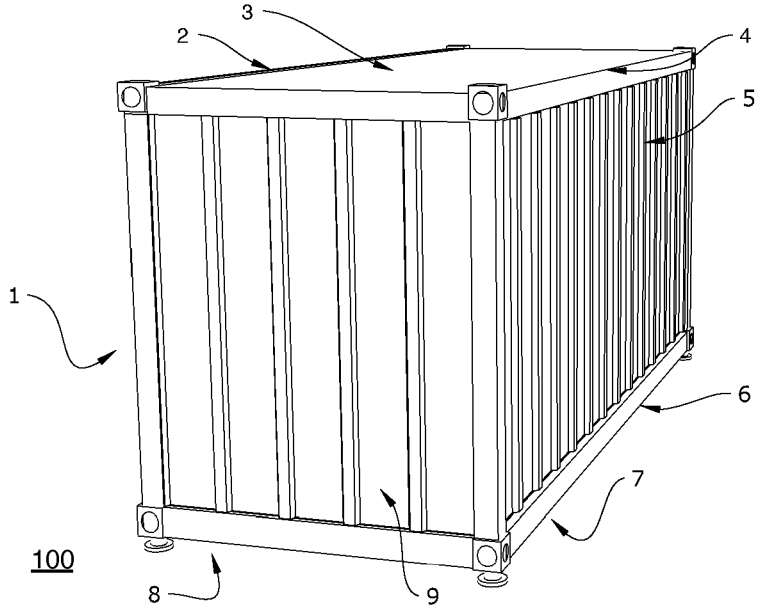
FIG. 1 is an isometric view of a convertible shipping container in a closed configuration, according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Intermodal shipping containers are manufactured according to International Standards Organization (ISO) dimensional specifications, which define a rectangular shape ideal for stacking on cargo ships. However, when used as habitable structures, these forms dictate flat roofs which limit or prevent water drainage. Standing water may cause material failures and eventual leaks, and debris and dirt buildup exacerbates the problem. Some attempted solutions have tried adding sloped roof structures which drive up costs due to redundancies, and often use roofing materials with relatively short life spans.

The rectangular appearance of shipping containers is generally undesirable for habitable spaces. Even in their modified states, they generally retain bulky, boxlike shapes which have limited aesthetic appeal compared to gable or sloped roofs which elicit an image of home, and also function better for water drainage. There are also solutions that create a space within the confines of a shipping container's 8-foot width and 8-foot height (or 9-foot for high cubes), but these may be quite restrictive for a container's use as a habitable space.

Existing solutions are insufficient for the needs of the industry owing to the shortcomings described above, and for a worldwide housing shortage. What is needed is a habitable structure that capitalizes on the shipping efficiencies, strength, and durability of shipping containers, while meeting aesthetic expectations and functional needs. The present inventive concept is self-contained, economical, easily transportable and quick to install, and addresses the deficiencies of other inventions in height and aesthetics.

There is currently a massive shortage of affordable housing, both nationally and internationally. As the Volkswagen® Beetle® once met the need for a "people's car," there is now a need for a "people's house," one that is affordable and unique to the market. Time-honored construction practices may be inadequate for the current challenge, and the solution lies in utilizing and connecting different technologies. Constructing homes in factory settings protected from the elements, regulated by quality control, and benefiting from the economies of mass production, enable a higher-quality, more durable product than those that typically characterize affordable housing.

Exemplary embodiments of the inventive concept relate to an intermodal shipping container, as shown in FIG. 1, that hinges open into a gable-roofed structure. According to exemplary embodiments, a habitable structure is created from an intermodal container by means of a hinged upper edge that enables the container's top and one side to open, thereby forming a gable roof and enlarging the space below. In its closed position the resulting product meets all the ISO and industry standards for shipping-container dimensions, structural integrity, and weather resistance, thus enabling it to be transported safely, efficiently, and economically. In its open position, exemplary embodiments transform the rectangular shape of a container in such a way that enables it to expand in both width and height, and function efficiently with water drainage and collection by means of an integrated gutter. The use of a high cube measuring 8-foot wide and 9-foot high means that when those two planes are lifted into a gable configuration, the asymmetry creates an overhang that protects the front wall from the elements.

The box-like shape and dimensional constraints of existing shipping containers limit existing container homes both aesthetically and in cubic measure. Exemplary embodiments address these shortcomings by altering a shipping container during the manufacturing process itself in such a way that the 'box' hinges open—expanding dimensions in width and height by creating a gable-roofed structure more in consonance with a conventional idea of a home.

According to exemplary embodiments, a fixed, 90° configuration in the connection of two of the container's planes may be retained—typically the top and a long side—in conjunction with a spring-loaded hinge on an upper edge. The 45° opening at this pivot point creates a 12/12 gable roof pitch. This expands the space both horizontally and vertically, and is particularly dramatic in the interior height.

Typically, stick-built gable roofs may require either tension ties, collar ties, or rafter ties in order to resist the horizontal outward thrust that may cause rafter separation from the ridge beam due to wind uplift or snow loads. However, tensioning components are not necessary if the ridge itself is structural. The steel frames of shipping containers are engineered to withstand the dynamic and impact forces of maritime shipping, and for instance may be stacked seven high on open seas. This same engineering framework is what serves as the gable roof ridge in exemplary embodiments of the present inventive concept, providing a structural ridge beam superior to stick-built structural ridge beams.

According to exemplary embodiments, some of the structure of a shipping container is breached in order to keep another part of the structure intact, so that the strength, rigidity, and weatherproofness is used where it is most valuable, as a roof ridge. For shipping and transport purposes, the convertible shipping container according to exemplary embodiments may be maintained in an alternate structural system that will allow for operability, and will conform to all the ISO standards for strength and weatherproofing.

Corner castings on the eight corners of a shipping container are typically strong because that is where locking mechanisms are placed that lock stacks of containers together. The corner castings are also where crane cables are hooked to lift and move shipping containers around. The corner castings may also be used for a delivery crane to lift the roof of the convertible shipping container up. Thus, according to exemplary embodiments, two of the corner castings are lifted so the roof will hinge up, rather than four of them as typically used to lift a whole shipping container. Further, since the roof is hinged up in exemplary embodiments, end doors and locking mechanisms that are an expensive component of regular shipping containers may not be needed.

As a product of the shipping container construction process, exemplary embodiments benefit from a sturdy, prepainted, ribbed steel structure, which significantly surpasses standard building materials in durability and lifespan. Incorporated into the manufacturing process is a spring-loaded opening mechanism, and the fabrication of building components that are either installed or stored for transport.

According to exemplary embodiments, pre-finished wall components for building out the structure in its expanded form may be shipped inside, allowing the dwelling or other structure to be assembled quickly once it reaches its destination. Once on site and hinged open into a habitable gable structure, the two ends of the container are removed and used as decking, and in their place the two gable end walls are installed under the newly-created roof by means of the delivery crane. The interlocking connections create seams located in protected vertical walls, leaving the roof surfaces intact. The side wall with entry door is installed in a similar manner, and encloses the opening created by the roof being raised.

Aesthetically, a gable structure offers a profile more in fitting with accepted housing types, which may lead to greater compatibility and acceptability in long-established communities. The present inventive concept capitalizes on the economies of creating a self-contained dwelling within the manufacturing process itself, thereby providing an affordable solution for housing and other structural needs. Furthermore, existing transportation networks enable delivery in a wide geographic range, at a reasonable cost, and exemplary embodiments can be readily available for rapid deployment in large quantities to meet the needs of widespread displacements after events such as wildfires, hurricanes, and other natural disasters.

Exemplary embodiments of the inventive concept transform the rectangular shape of a container in such a way that enables it to expand in both width and height, releasing it from the restricted 8-foot width and 8-foot height (or 9-foot for high cubes) of shipping containers as regulated by the ISO. Lengths of the structures are also dictated by ISO standards, typically 20-foot and 40-foot. In geometrical terms, the closed container is the width of one leg of a right triangle, and the opened container expands the structure to the width of its hypotenuse. The height of the space is also increased—by the distance between the hypotenuse and the intersection of the two legs that form the right angle.

The convertible shipping container according to the exemplary embodiments described herein include:

(1) first longitudinal wall panel;
(2) hinged edge between (1), first longitudinal wall panel, and (3), top panel;
(3) top panel;
(4) fixed 90° edge between (3), top panel and (5), second longitudinal wall panel;
(5) second longitudinal wall panel;
(6) locked and openable edge between (5), second longitudinal wall panel and (7), container bottom;
(7) container bottom;
(8) fixed 90° edge between (7), container bottom and (1), first longitudinal wall panel;
(9) first end panel;
(10) second end panel;
(11) floor extension;
(12) first gable end panel shipped inside container;
(13) second gable end panel shipped inside container;
(14) front wall panel shipped in two parts inside container;
(15) integrated gutter; and
(16) foundation footers.

Figure 2:
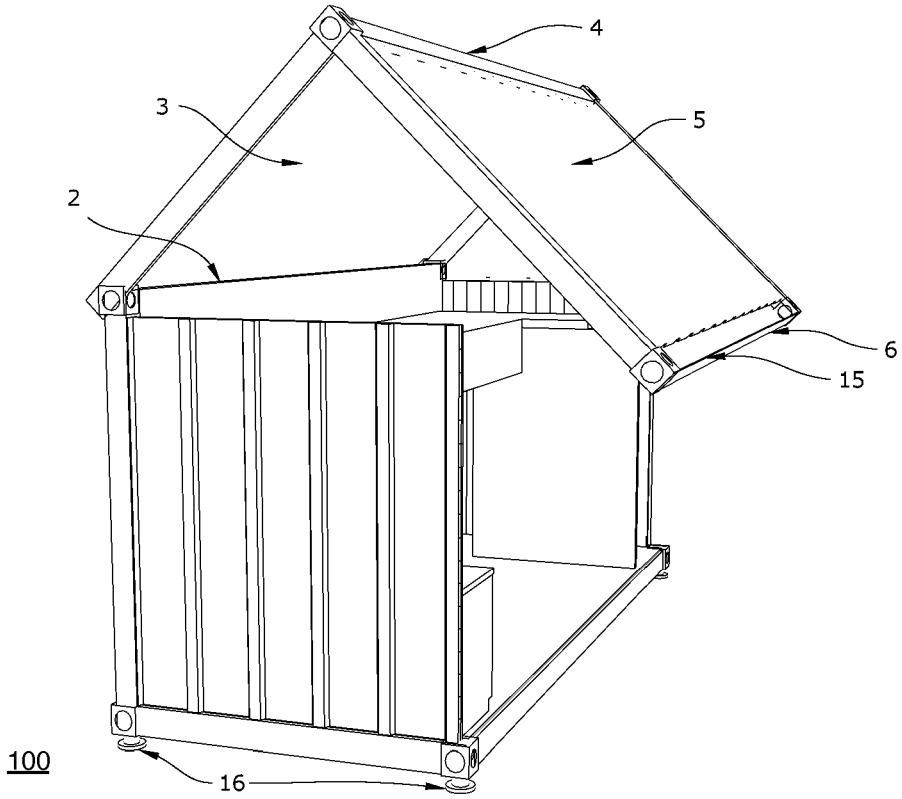
FIG. 2, FIG. 3, FIG. 4, FIG. 5, and FIG. 6 are isometric views of the convertible shipping container of FIG. 1 in an open configuration, according to the present exemplary embodiment.

As shown in FIG. 1 and FIG. 2, a convertible shipping container 100 according to an exemplary embodiment may be modified during a manufacturing process to create two, diagonally-opposed, fixed 90° longitudinal edges 4 and 8, as per standard container fabrication methods, and one hinged longitudinal edge 2, and one locked longitudinal edge 6 that is openable. When the longitudinal edge 6 is unlocked and opened, the adjacent, fixed second longitudinal wall panel 5 and top panel 3 open to create two sides of a gabled roof. The fixed 90° longitudinal edge 4 is therefore considered as a gable roof ridge. A gutter 15 is integrated in the longitudinal edge 6. Accordingly, when the gabled roof is formed, the longitudinal edge 6 is at the upper edge of the convertible shipping container 100, and not only becomes the gutter 15, but offers additional strength for the gabled roof, for instance to withstand snow loads.

Figure 3:
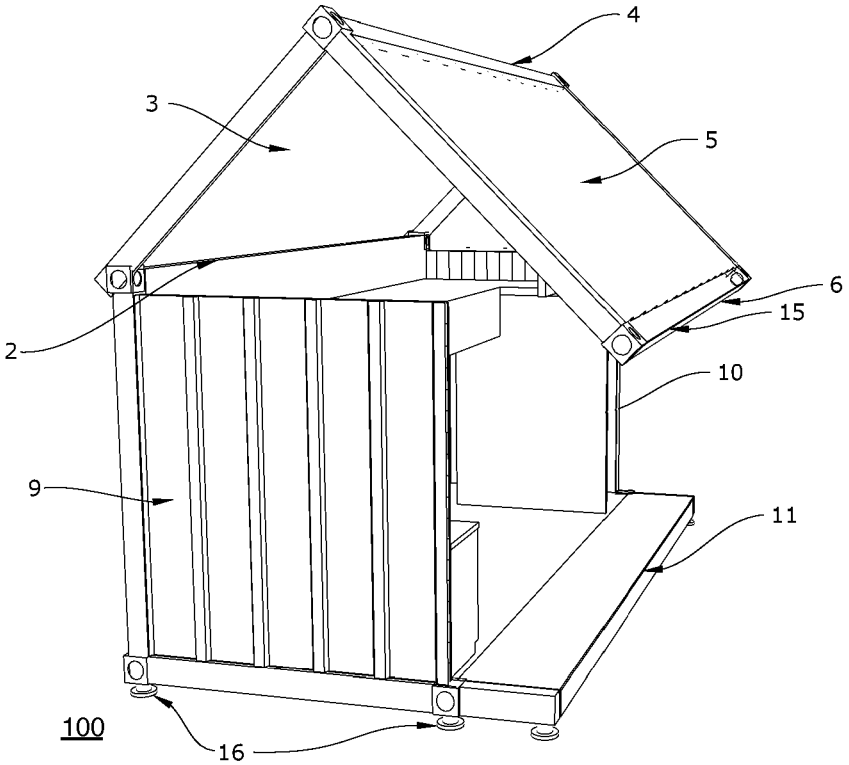
Figure 4:
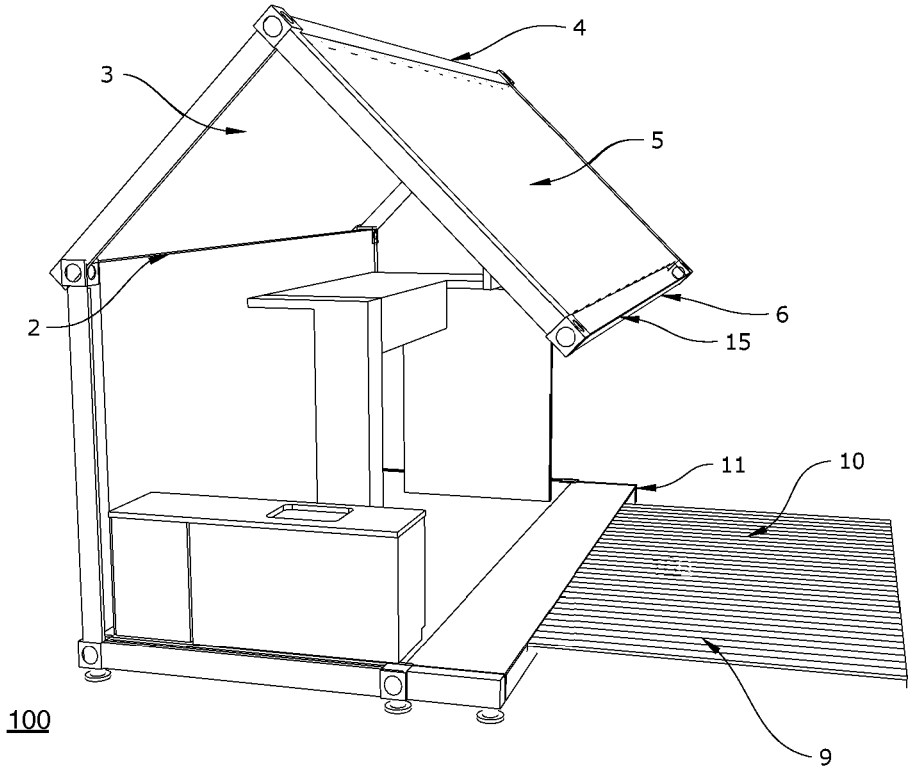

The geometrical change in cross-section occurring when the gabled roof is opened increases the width of the convertible shipping container 100. As shown in FIG. 3 and FIG. 4, a floor extension 11 is affixed to container bottom 7 longitudinal open edge, extending the structure to accommodate the new width. A first end panel 9 and a second end panel 10 are removed and fastened horizontally to one another, and the long edge created by this combination is affixed to the long open floor edge of the container bottom 7, thereby creating an exterior front deck. Foundation footers 16, including self-leveling steel pile footers, are attached to the bottom of the convertible shipping container 100.

Figure 5:
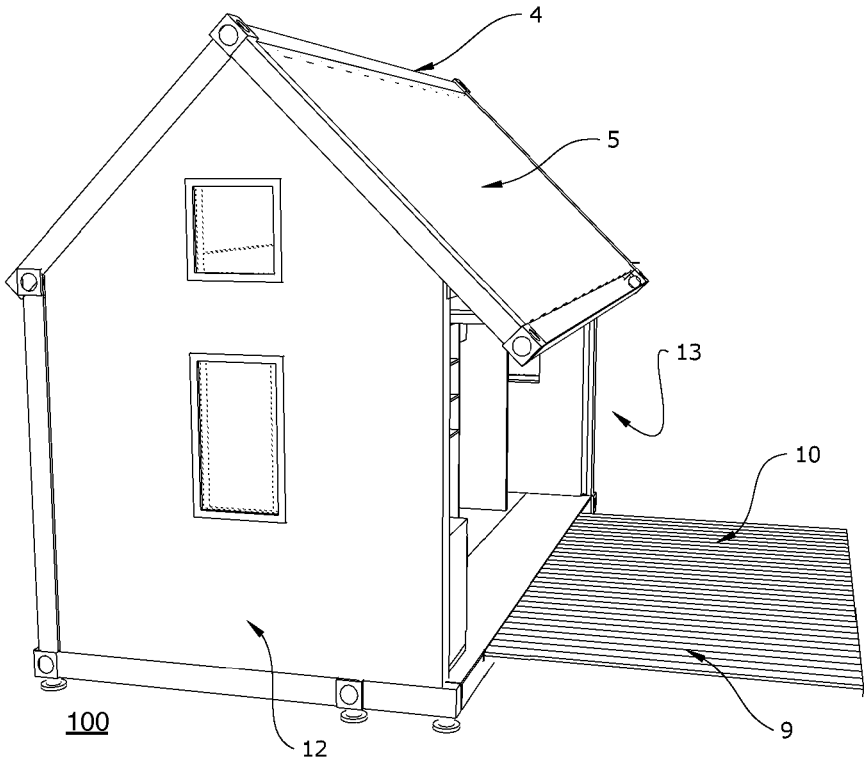

As shown in FIG. 5, a first gable end panel 12 and a second gable end panel 13, which are prefabricated and shipped inside the convertible shipping container 100, are installed in place of the removed first end panel 9 and second end panel 10. The gable roof locks down over the first gable end panel 12 and second gable end panel 13 at an angle of about 45° from its original configuration, in which case it creates a 12/12 pitch on both sides of the roof.

Figure 6:
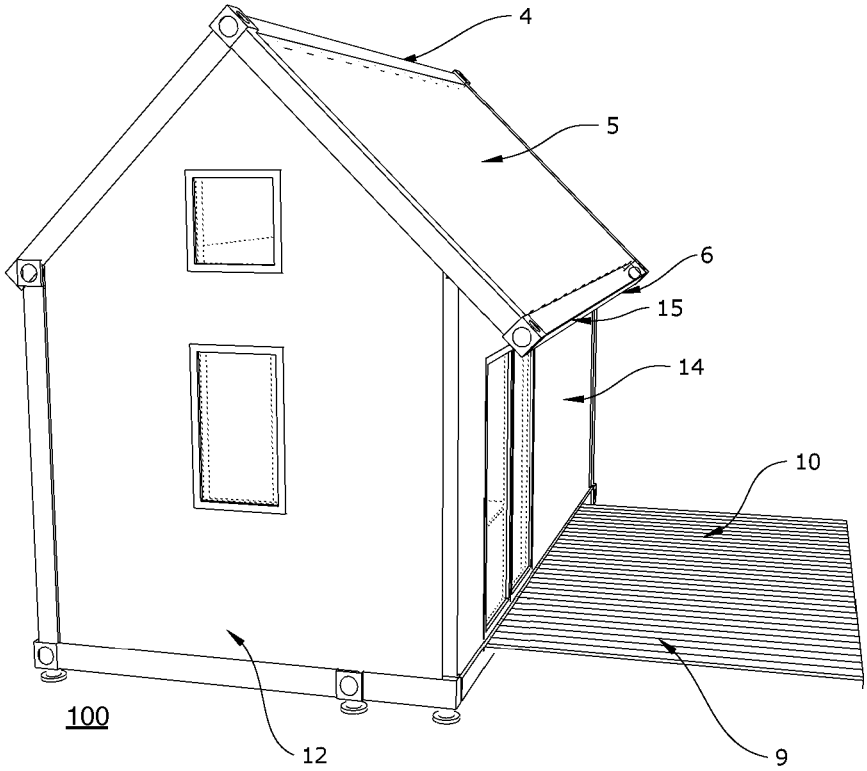
Figure 7:
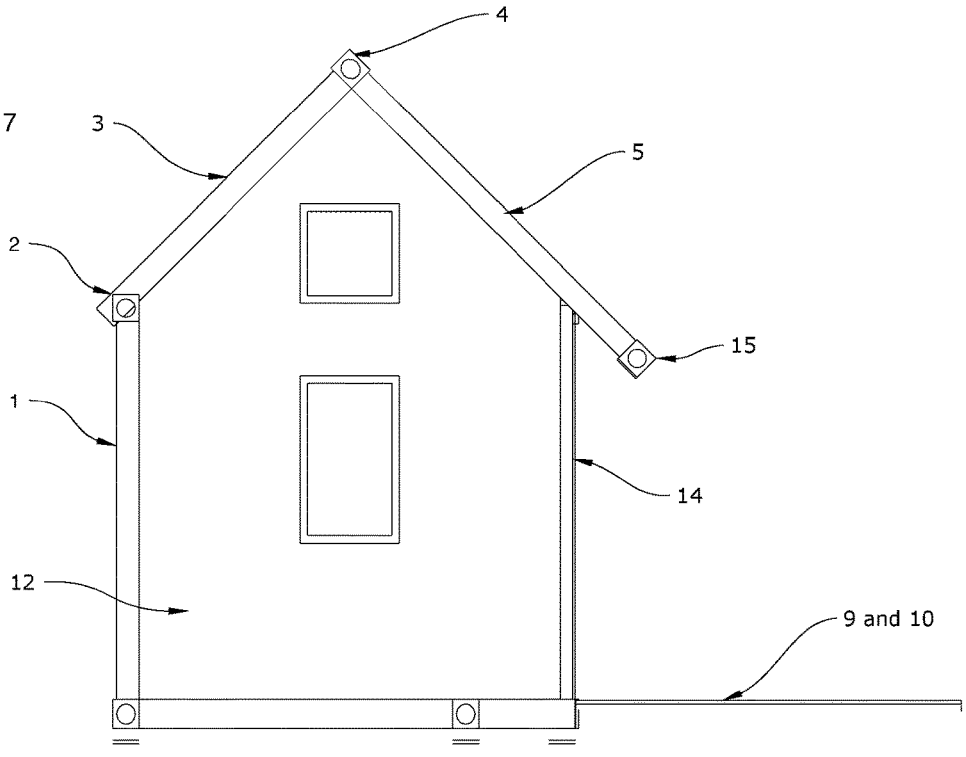
FIG. 7 is left side view of the convertible shipping container of FIG. 6, according to the present exemplary embodiment.
Figure 8:
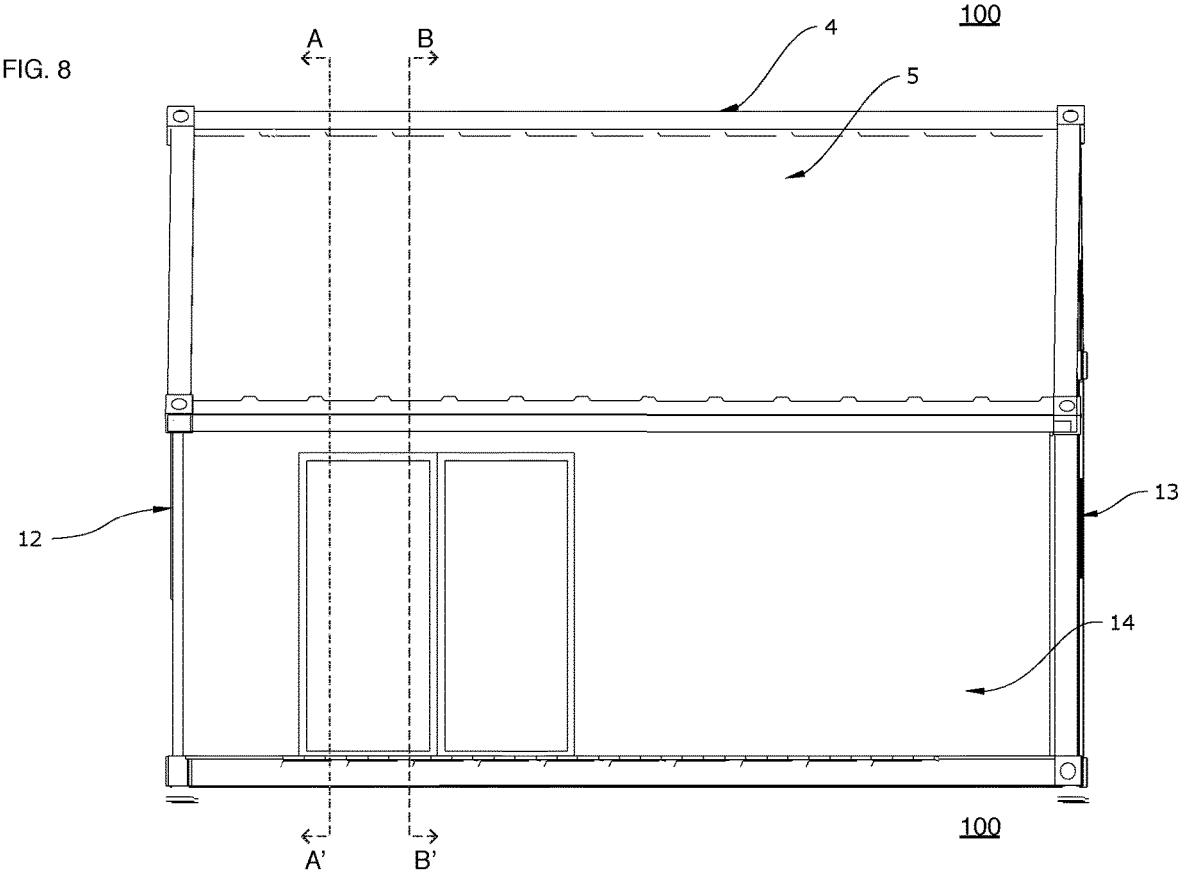
FIG. 8 is a front view of the convertible shipping container of FIG. 6 according to the present exemplary embodiment.
Figure 9:
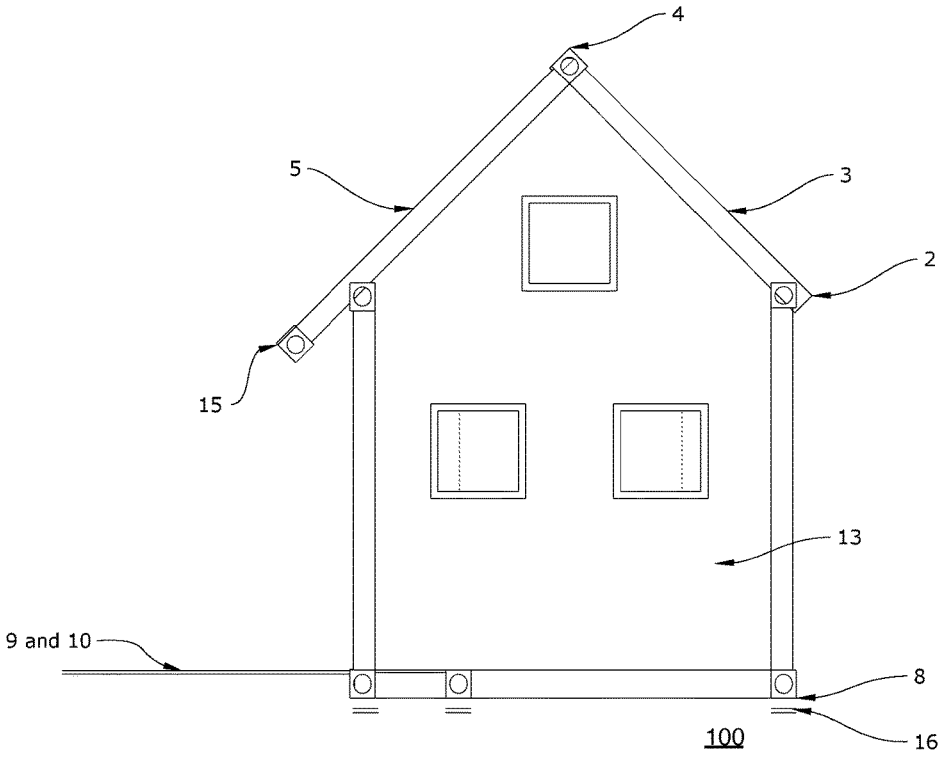
FIG. 9 is a right side view of the convertible shipping container of FIG. 6 according to the present exemplary embodiment.
Figure 10:
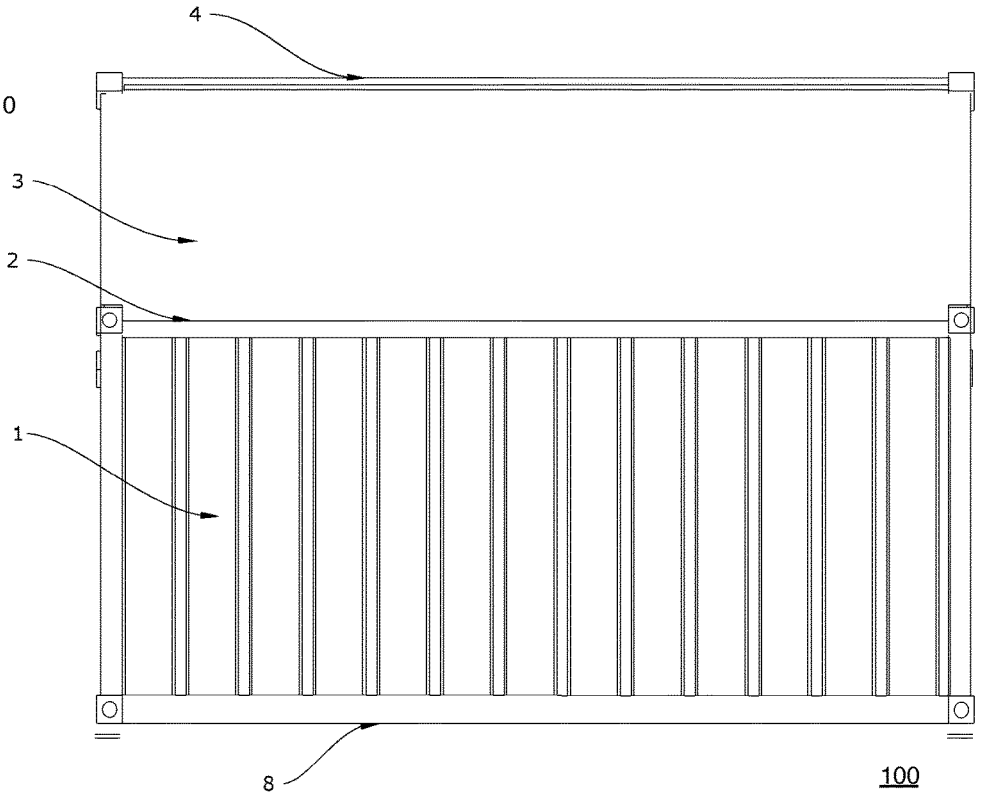
FIG. 10 is a rear view of the convertible shipping container of FIG. 6 according to the present exemplary embodiment.
Figure 11:
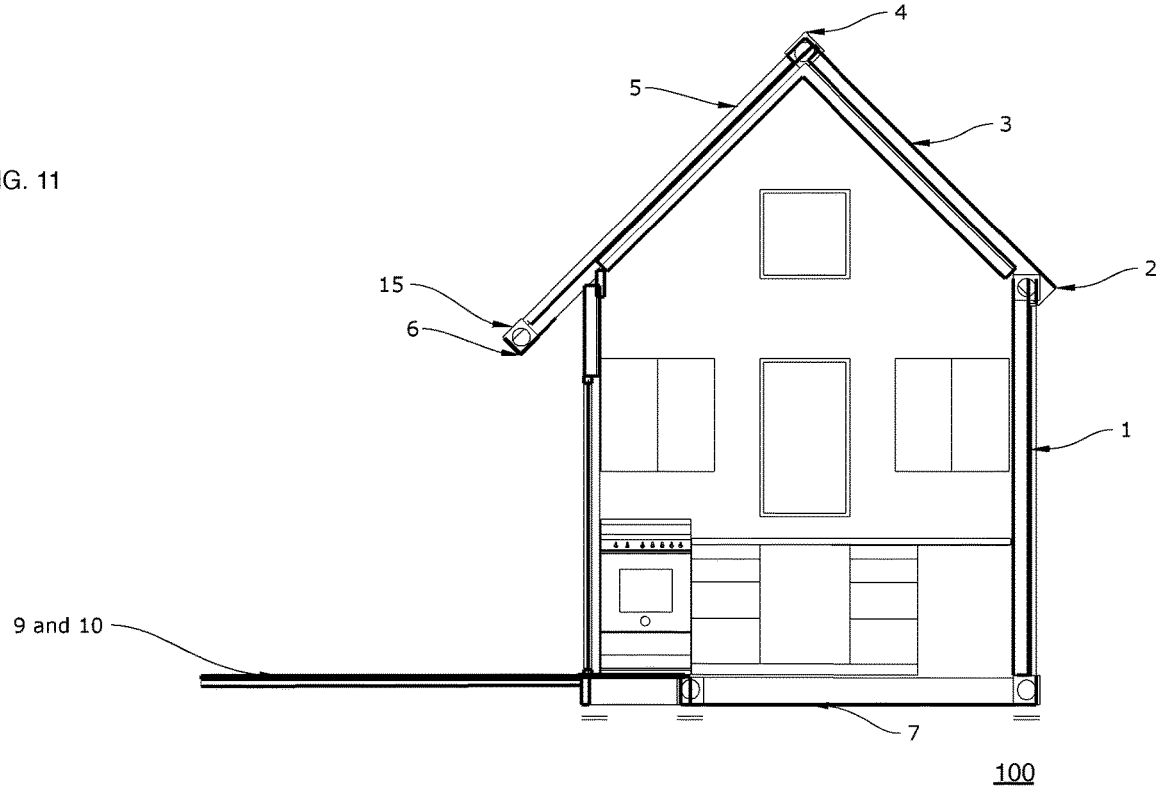
FIG. 11 is a cross-sectional view of the convertible shipping container taken along line A-A' of FIG. 8, according to the present exemplary embodiment.
Figure 12:
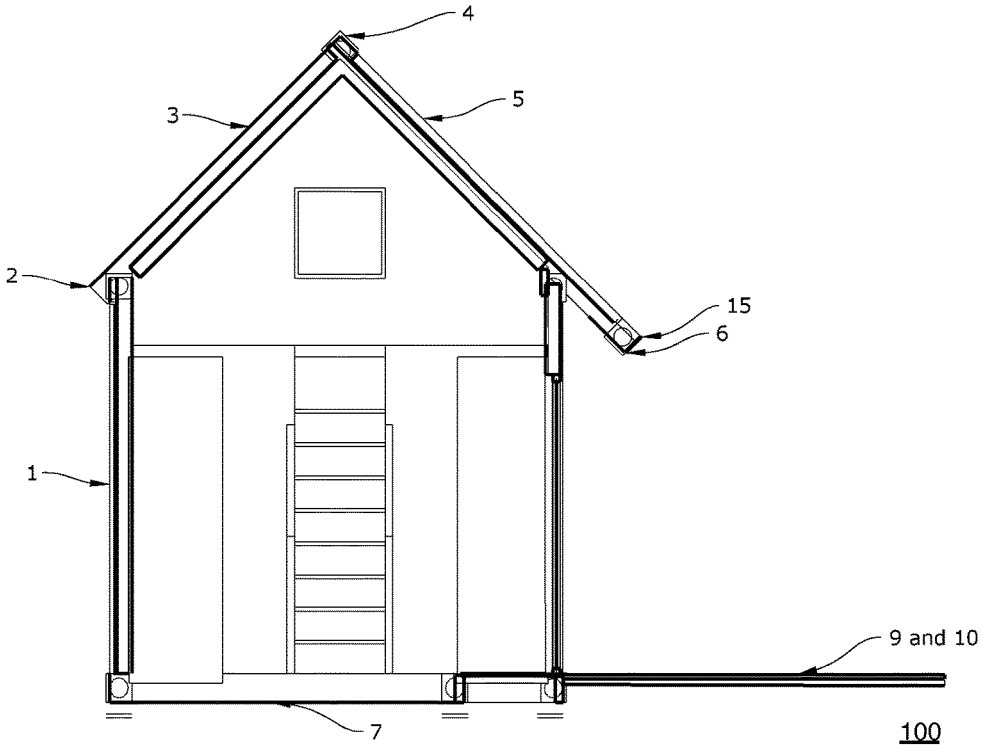
FIG. 12 is a cross-sectional view of the convertible shipping container taken along line B-B' of FIG. 8, according to the present exemplary embodiment.

As shown in FIG. 6, a front wall panel 14 is attached to the convertible shipping container 100 and encloses the structure, in place of the second longitudinal wall panel 5.

The front wall panel 14 is made of a two-part prefabricated panel shipped inside the convertible shipping container 100. The first gable end panel 12, second gable end panel 13, and front wall panel 14 are three-layered panels and are constructed from interior wall board, rigid insulation, and exterior metal sheathing, with door and windows pre-installed.

In the convertible shipping container 100 manufacturing process according to the present exemplary embodiment, insulation and wallboard or other surface materials are also affixed to the interior faces of the first longitudinal wall panel 1 back wall, and to the interior of the top panel 3 and second longitudinal wall panel 5, which form the gable roof. A metal pan is welded to the steel crossmembers of the container bottom 7, creating a cavity then filled with closed-cell spray foam insulation. Subfloor and finished flooring are installed on the upper side of the crossmembers. The floor extension 11 is constructed in a similar manner.

Utilities, cabinetry, and interior walls are installed in some parts of the convertible shipping container 100 cavity, with the remainder shipped inside the convertible shipping container 100 and installed on-site. Electrical wiring, plumbing, and other utilities are integrated into walls and flooring, with final connections made on-site. The increased height created by the gable roof in its hinged-open position can accommodate a two-level interior space.

When closed, the convertible shipping container 100 according to the exemplary embodiments described herein is an industry-standard, intermodal shipping container, benefiting from all the advantages thereof: strength, durability, economy, and ease of shipping through multiple means of transport. When opened and assembled, the convertible shipping container 100 is a fully-functional, habitable structure, benefiting from cost-effective fabrication, quick deployability, and minimal assembly required for conversion into a habitable space.

The convertible shipping container according to the present exemplary embodiments relates to a habitable structure in which one of the container's upper longitudinal edges with adjacent, rigidly-connected top and side, hinges open, resulting in a 12/12 pitch gable roof, the geometry of which increases the usable space underneath in both width and height, which is then enclosed with supplemental, prefabricated wall panels.

As a dwelling, the shipping container according to the present exemplary embodiments meet the needs of populations displaced by catastrophic events, those lacking affordable housing, or those living a minimalist lifestyle. In addition to functioning as a dwelling unit, other ways or means or components are also contemplated for the shipping container according to the present exemplary embodiments, including but not limited to: residence, office, studio, and shop.

The hinged/fixed/locked/fixed container edge configuration described above can have alternative embodiments, including but not limited to: retaining walls, portable stages, outdoor cinemas, outdoor exhibitions, and trade show exhibitions.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangement.

I claim:

1. A convertible container, comprising:

a top panel;

a first longitudinal wall panel having a first longitudinal edge, the first longitudinal edge connected to the top panel via a hinge;

a second longitudinal wall panel having a second longitudinal edge and a third longitudinal edge spaced apart from the second longitudinal edge, the second longitudinal edge connected to the top panel at a fixed 90-degree angle; and a bottom panel having an openable edge, the bottom panel permanently coupled to the first longitudinal wall panel and removably coupled to the second longitudinal wall panel at the openable edge;

wherein the top panel and the second longitudinal wall panel are moveable between a first configuration and a second configuration, wherein there is a temporary opening disposed between the top panel and the second longitudinal wall panel as the top panel is moved from the first configuration to the second configuration, the top panel oriented on a first plane, the second longitudinal wall panel oriented on a second plane, and the first longitudinal edge and the third longitudinal edge disposed on a third plane, and wherein the first plane, the second plane, and the third plane intersect to define an empty volume having a triangular cross-section with open ends, the temporary opening defined by the empty volume, and wherein the second longitudinal edge is defined by a structural ridge beam oriented along an entire length of each of the top panel and the second longitudinal wall panel, the structural ridge beam connecting the top panel and the second longitudinal wall panel and rigidly holding the top panel and the second longitudinal wall panel at the fixed 90-degree angle.

2. The convertible container of claim 1, wherein the top panel is disposed at a 90-degree angle relative to the first longitudinal wall panel where the top panel is in the first configuration.

3. The convertible container of claim 1, wherein the top panel is disposed at a 135-degree angle relative to the first longitudinal wall panel where the top panel is in the second configuration.

4. The convertible container of claim 1, wherein the top panel and the second longitudinal wall panel define a gable roof where the top panel is in the second configuration.

5. The convertible container of claim 4, wherein the gable roof has a 12/12 pitch.

6. The convertible container of claim 1, wherein the convertible container further includes a first end panel configured to be detachably connected to a first end of the bottom panel in the first configuration and a second end panel configured to be detachably connected to a second end of the bottom panel in the first configuration.

7. The convertible container of claim 6, further comprising a floor extension with an open edge, the floor extension disposed in the convertible container where the top panel is in the first configuration and configured to be removably disposed on the open edge of the bottom panel where the top panel is in the second configuration.

8. The convertible container of claim 7, wherein the first end panel and the second end panel are configured to be disposed on the open edge of the floor extension where the top panel is in the second configuration.

9. The convertible container of claim 6, further comprising a first gable end panel configured to be detachably connected to the first end of the bottom panel in the second configuration and a second gable end panel detachably connected to the second end of the bottom panel in the second configuration.

10. The convertible container of claim 9, wherein the first gable end panel and the second gable end panel are configured to be disposed within the convertible container in the first configuration.

11. The convertible container of claim 8, further comprising a front wall panel, the front wall panel configured to be disposed on the open edge of the floor extension and removably connected with the second longitudinal wall panel in the second configuration.

12. The convertible container of claim 11, wherein the front wall panel is configured to be disposed within the convertible container in the first configuration.

13. The convertible container of claim 9, wherein the first gable end panel and the second gable end panel are fabricated from materials including from interior wall board, rigid insulation, and exterior metal sheathing.

14. The convertible container of claim 9, wherein at least one of the first gable end panel and the second gable end panel have a window formed therein.

15. The convertible container of claim 11, wherein front wall panel includes an interior wall board, rigid insulation, and exterior metal sheathing.

16. The convertible container of claim 11, wherein the front wall panel has a door formed therethrough.

17. The convertible container of claim 1, wherein the second longitudinal wall panel has an integrated gutter formed on the third longitudinal edge.

18. The convertible container of claim 1, wherein the bottom panel includes foundation footers.

19. A method of assembling a functional structure, the method comprising:

providing a convertible container including:

a top panel;

a first longitudinal wall panel having a first longitudinal edge, the first longitudinal edge connected to the top panel via a hinge;

a second longitudinal wall panel having a second longitudinal edge and a third longitudinal edge spaced apart from the second longitudinal edge, the second longitudinal edge connected to the top panel at a fixed 90-degree angle; and a bottom panel having an openable edge, the bottom panel permanently coupled to the first longitudinal wall panel and removably coupled to the second longitudinal wall panel at the openable edge;

wherein the top panel and the second longitudinal wall panel are moveable between a first configuration and a second configuration, wherein there is a temporary opening disposed between the top panel and the second longitudinal wall panel as the top panel is moved from the first configuration to the second configuration, the top panel oriented on a first plane, the second longitudinal wall panel oriented on a second plane, and the first longitudinal edge and the third longitudinal edge disposed on a third plane, and wherein the first plane, the second plane, and the third plane intersect to define an empty volume having a triangular cross-section with open ends, the temporary opening defined by the empty volume, and wherein the second longitudinal edge is defined by a structural ridge beam oriented along an entire length of each of the top panel and the second longitudinal wall panel, the structural ridge beam connecting the top panel and the second longitudinal wall panel and rigidly holding the top panel and the second longitudinal wall panel at the fixed 90-degree angle; and lifting and rotating the second longitudinal wall panel away from the bottom panel about the hinge.

20. The method of claim 19, wherein the convertible container further includes a first gable end panel, a second gable end panel, a front wall, and a floor extension panel, and the method further includes steps of:

removing the first end panel from a first end of the bottom panel and removing the second end panel from a second end of the bottom panel;

disposing the first gable end panel on the first end of the bottom panel and attached to the first longitudinal wall panel, the top panel, and the second longitudinal wall panel;

disposing the second gable end panel on the second end of the bottom panel and attached to the first longitudinal wall panel, the top panel, and the second longitudinal wall panel;

disposing the floor extension panel on the openable edge of the bottom panel; and disposing the front wall on an open edge of the floor extension panel and connected to the second longitudinal wall panel, thereby enclosing the functional structure.

* * * * *